US009404681B2

(12) United States Patent
Korenaga et al.

(10) Patent No.: US 9,404,681 B2
(45) Date of Patent: Aug. 2, 2016

(54) AIR-CONDITIONING APPARATUS

(75) Inventors: Kazunori Korenaga, Tokyo (JP); Takeshi Kuramochi, Tokyo (JP); Hirofumi Horiuchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 208 days.

(21) Appl. No.: 13/984,307

(22) PCT Filed: Mar. 5, 2012

(86) PCT No.: PCT/JP2012/001501

§ 371 (c)(1),
(2), (4) Date: Aug. 8, 2013

(87) PCT Pub. No.: WO2012/120868

PCT Pub. Date: Sep. 13, 2012

(65) Prior Publication Data

US 2013/0305764 A1 Nov. 21, 2013

(30) Foreign Application Priority Data

Mar. 7, 2011 (JP) ..... 2011-048960

(51) Int. Cl.
*F25B 41/04* (2006.01)
*F25B 45/00* (2006.01)
(Continued)

(52) U.S. Cl.
CPC ..... *F25B 45/00* (2013.01); *F25B 41/043* (2013.01); *F25B 41/046* (2013.01); *F25B 43/00* (2013.01);
(Continued)

(58) Field of Classification Search
CPC .. F25B 41/043; F25B 45/00; F25B 2312/005; F25B 2345/001; F25B 2345/006; F25B 2400/053; F25B 2400/16; F25B 2400/162; F25B 2600/2523
See application file for complete search history.

(56) References Cited

U.S. PATENT DOCUMENTS 3,400,552 A * 9/1968 Johnson et al. ..... 62/149
5,353,603 A * 10/1994 Outlaw et al. ..... 62/149
(Continued)

FOREIGN PATENT DOCUMENTS

AU 2007225990 B2 9/2007
CN 1244247 A 2/2000
(Continued)

OTHER PUBLICATIONS

International Search Report of the International Searching Authority mailed May 22, 2012 for the corresponding international application No. PCT/JP2012/001501 (and English translation).
(Continued)

*Primary Examiner* — Judy Swann
*Assistant Examiner* — Christopher R Zerphey
(74) *Attorney, Agent, or Firm* — Posz Law Group, PLC

(57) ABSTRACT

In an air-conditioning apparatus equipped with an outdoor unit having outdoor devices including a compressor that compresses a refrigerant, a flow switching valve that switches the flowing direction of the refrigerant, an outdoor heat exchanger that exchanges heat between the refrigerant and outdoor air, a first expansion valve that reduces the pressure of the refrigerant, an excess-refrigerant container that retains an excess refrigerant of the refrigerant, and a second expansion valve that reduces the pressure of the refrigerant; and an indoor unit having an indoor heat exchanger that exchanges heat between the refrigerant and indoor air, the air-conditioning apparatus includes an outdoor-heat-exchanger refrigerant injection port provided in a refrigerant pipe that is directly connected to the outdoor heat exchanger, and an excess-refrigerant-container refrigerant injection port provided in a refrigerant pipe that is directly connected to the excess-refrigerant container.

13 Claims, 9 Drawing Sheets

(51) Int. Cl.
*F25B 43/00* (2006.01)
*F25B 1/00* (2006.01)

(52) U.S. Cl.
CPC ..... *F25B 1/00* (2013.01); *F25B 2345/001* (2013.01); *F25B 2345/006* (2013.01); *F25B 2400/053* (2013.01); *F25B 2400/16* (2013.01)

(56) References Cited

U.S. PATENT DOCUMENTS

| | | | | |
|---|---|---|---|---|
| 5,970,721 | A * | 10/1999 | Kamimura et al. | 62/77 |
| 6,158,229 | A * | 12/2000 | Aizawa | 62/77 |
| 2003/0192335 | A1 * | 10/2003 | Rembold et al. | 62/292 |
| 2006/0080989 | A1 * | 4/2006 | Aoki et al. | 62/324.4 |
| 2008/0011003 | A1 * | 1/2008 | Douglas et al. | 62/149 |
| 2009/0266093 | A1 | 10/2009 | Aoki | |
| 2011/0132011 | A1 * | 6/2011 | Kojima | 62/180 |

FOREIGN PATENT DOCUMENTS

| | | | |
|---|---|---|---|
| CN | 101052848 | A | 10/2007 |
| CN | 101379351 | A | 3/2009 |
| EP | 1 826 513 | A1 | 8/2007 |
| EP | 1 992 893 | A1 | 11/2008 |
| JP | 03-160286 | A | 7/1991 |
| JP | H04-048168 | A | 2/1992 |
| JP | 05-133633 | A | 5/1993 |
| JP | 05-312439 | A | 11/1993 |
| JP | H08-285413 | A | 11/1996 |
| JP | 10-281597 | A | 10/1998 |
| JP | 2001-241814 | A | 9/2001 |
| JP | 2005-009753 | A | 1/2005 |
| JP | 2007-192496 | A | 8/2007 |
| JP | 2009-299981 | A | 12/2009 |
| WO | 2007/013382 | A1 | 2/2007 |
| WO | 2007/049372 | A1 | 5/2007 |

OTHER PUBLICATIONS

Extended European Search Report dated Aug. 14, 2014 issued in corresponding EP patent application No. 12754570.5.
Office Action dated Jan. 21, 2015 issued in corresponding CN patent application No. 2012800119645 (and English translation).
Office Action mailed Aug. 19, 2014 issued in corresponding JP patent application No. 2013-503387 (and English translation).
Office Action mailed Apr. 21, 2015 issued in corresponding JP patent application No. 2013-503387 (and English translation).
Office Action Issued Sep. 30, 2015 in the corresponding CN application No. 201280011964.5 (with English translation).
Office Action dated Apr. 15, 2016 issued in the corresponding Chinese patent application No. 201280011964.5 (and English translation).

* cited by examiner

AIR-CONDITIONING APPARATUS

CROSS REFERENCE TO RELATED APPLICATIONS

This application is a U.S. national stage application of PCT/JP2012/001501 filed on Mar. 5, 2012, and claims priority to, and incorporates by reference, Japanese Patent Application No. 2011-048960 filed on Mar. 7, 2011.

TECHNICAL FIELD

The present invention relates to air-conditioning apparatuses, and in particular, relates to a configuration for injecting a refrigerant into a refrigerant circuit of an air-conditioning apparatus.

BACKGROUND ART

A common air-conditioning apparatus is equipped with an outdoor unit having a compressor, a four-way valve serving as flow switching means for switching the flowing direction of a refrigerant, an outdoor heat exchanger and a pressure-reducing capillary tube connected to an outlet of the outdoor heat exchanger, and an electronic expansion valve that further reduces the pressure of the refrigerant after having passed through the capillary tube; and an indoor unit having an indoor heat exchanger. The aforementioned devices contained in the outdoor unit and the indoor unit are sequentially connected by refrigerant pipes in the form of a circuit, and the refrigerant circulates through the refrigerant circuit, whereby a refrigeration cycle is formed. When the indoor heat exchanger operates as an evaporator and the outdoor heat exchanger operates as a condenser, indoor cooling is achieved. On the other hand, when the indoor heat exchanger operates as a condenser and the outdoor heat exchanger operates as an evaporator, indoor heating is achieved. The four-way valve provided at the discharge side of the compressor switches the flowing direction of the refrigerant so that the refrigerant discharged from the compressor is condensed by the indoor heat exchanger or the outdoor heat exchanger. Fans are disposed near the indoor heat exchanger and the outdoor heat exchanger and send indoor air and outdoor air thereto, respectively.

In recent years, outdoor units that can be used in various ways and can be connected to various types of indoor units in accordance with users' demands are in demand. In this case, since the capacity of and the amount of air for the indoor heat exchanger vary depending on the type of indoor unit, the amount of refrigerant for allowing the refrigeration cycle to exhibit maximum performance would also vary. In order to properly adjust the amount of refrigerant circulating through the refrigerant circuit, an excess-refrigerant container is provided in the refrigerant circuit for retaining an excess refrigerant. A receiver serving as this excess-refrigerant container is often disposed in a suction pipe of the compressor or at a position where a liquid refrigerant exists, such as a position between an outlet of the condenser and an inlet of the evaporator.

In the air-conditioning apparatus having such a configuration, if a large amount of refrigerant that covers the entire refrigerant circuit is to be injected into the refrigerant circuit during production or maintenance of the air-conditioning apparatus, the refrigerant is injected from a refrigerant injection port provided in the refrigerant circuit. In particular, a configuration is disclosed in which the refrigerant is injected into the refrigerant circuit from a refrigerant injection port provided in the suction pipe of the compressor, an inlet pipe of a heat exchanger, or an outlet pipe of the heat exchanger (e.g., see Patent Literature 1).

CITATION LIST

Patent Literature

Patent Literature 1: Japanese Unexamined Patent Application Publication No. 5-312439 (paragraph 0025, FIG. 5)

SUMMARY OF INVENTION

Technical Problem

Among the devices constituting the refrigerant circuit of the air-conditioning apparatus, the refrigerant is retained mainly in the compressor, the heat exchanger, and the excess-refrigerant container. Therefore, upon injection of the refrigerant into the refrigerant circuit, it is necessary to inject the refrigerant so that the refrigerant flows into the devices in which a large amount of refrigerant is to be retained. In the apparatus in the conventional art, the refrigerant is injected from a certain location of the refrigerant circuit, such as from the refrigerant injection port provided in the suction pipe of the compressor, the inlet pipe of the heat exchanger, or the outlet pipe of the heat exchanger. Even if the refrigerant is injected from the refrigerant injection port provided at any of these locations, the electronic expansion valve, the capillary tube, and the like that are provided for reducing the pressure of the refrigerant in the refrigerant circuit act as pressure-reducing members, making it impossible to reliably inject the refrigerant into the aforementioned devices, in which the refrigerant is to be mainly retained, in a well-balanced manner within a short period of time. Specifically, it takes time for the refrigerant to pass through the pressure-reducing members, thus requiring a long time for the refrigerant injection process. In addition, the pressure-reducing members act as resistance that causes the refrigerant to be injected lopsidedly to a specific device, which is a problem in that a liquid-sealed state may possibly occur. When this liquid-sealed state occurs, a liquid refrigerant expands in response to a temperature change, sometimes causing an abnormal increase in internal pressure.

Furthermore, with regard to a separate-type air-conditioning apparatus in which the indoor unit installed indoors and the outdoor unit installed outdoors are separated from each other, there is a problem in that, when an amount of refrigerant required in the entire refrigerant circuit is to be injected into the outdoor unit, an optimal position for a refrigerant injection port for reliably injecting the refrigerant in a well-balanced manner is not clearly defined.

The present invention has been made to solve the aforementioned problems and an object thereof is to provide an air-conditioning apparatus in which an amount of refrigerant required in a refrigerant circuit is reliably injected into the refrigerant circuit in a well-balanced manner within a short period of time at an outdoor-unit side so that the occurrence of a liquid-sealed state can be prevented.

Solution to Problem

An air-conditioning apparatus according to the present invention includes an outdoor unit having outdoor devices including a compressor that compresses a refrigerant, a flow switching valve that switches a flowing direction of the refrigerant, an outdoor heat exchanger that exchanges heat between the refrigerant and outdoor air, a first expansion valve that reduces pressure of the refrigerant, an excess-refrigerant container that retains an excess refrigerant of the refrigerant, and a second expansion valve that reduces the pressure of the refrigerant; and an indoor unit having an indoor heat exchanger that exchanges heat between the refrigerant and indoor air. The outdoor devices and the indoor heat exchanger are sequentially connected by refrigerant pipes so that a refrigeration cycle is formed. The air-conditioning apparatus further includes an outdoor-heat-exchanger refrigerant injection port provided in the refrigerant pipe that is directly connected to the outdoor heat exchanger, and an excess-refrigerant-container refrigerant injection port provided in the refrigerant pipe that is directly connected to the excess-refrigerant container.

Advantageous Effects of Invention

In the air-conditioning apparatus according to the present invention, the refrigerant is injected into the outdoor heat exchanger from the outdoor-heat-exchanger refrigerant injection port, and the refrigerant is injected into the excess-refrigerant container from the excess-refrigerant-container refrigerant injection port, so that the refrigerant is injected into the outdoor heat exchanger and the excess-refrigerant container, which have large capacities, without the refrigerant being retained lopsidedly in one device in the refrigerant circuit. Thus, an amount of refrigerant required in the refrigerant circuit can be reliably injected thereto in a well-balanced manner within a short period of time, whereby a safe air-conditioning apparatus that prevents the occurrence of a liquid-sealed state is obtained.

DESCRIPTION OF EMBODIMENTS

Embodiment 1

Figure 1:
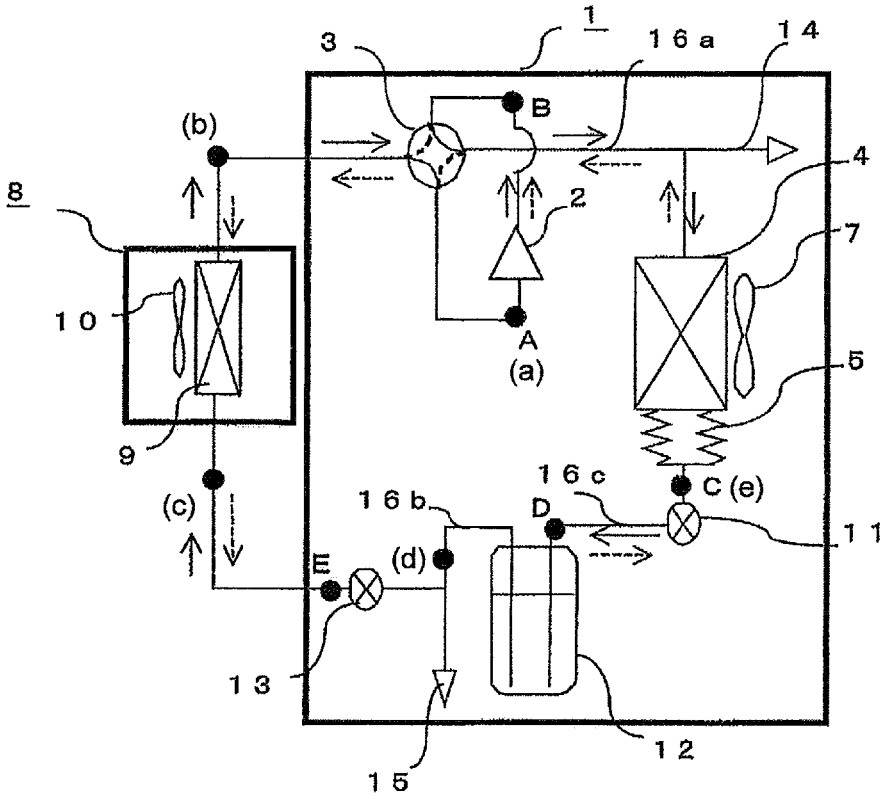
FIG. 1 is a schematic diagram illustrating a refrigerant circuit of an air-conditioning apparatus according to Embodiment 1 of the present invention.

FIG. 1 is a schematic diagram illustrating a refrigerant circuit of an air-conditioning apparatus according to Embodiment 1 of the present invention. This air-conditioning apparatus has an outdoor unit 1 and an indoor unit 8. The outdoor unit 1 contains outdoor devices, which include a compressor 2 that compresses a refrigerant; a four-way valve 3 serving as a flow switching valve that switches the flowing direction of the refrigerant; an outdoor heat exchanger 4 that exchanges heat between the refrigerant and outdoor air; a pressure-reducing capillary tube 5 connected to an outlet of the outdoor heat exchanger 4; a first expansion valve 11 and a second expansion valve 13, in this case, a first electronic expansion valve 11 and a second electronic expansion valve 13 serving as electronic pressure-reducing means, which further reduce the pressure of the refrigerant reduced in pressure by the capillary tube 5; and an intermediate-pressure receiver 12 provided between the first electronic expansion valve 11 and the second electronic expansion valve 13 and serving as an excess-refrigerant container that retains an excess refrigerant. The indoor unit 8 contains an indoor heat exchanger 9 that exchanges heat between the refrigerant and indoor air. The outdoor devices (i.e., the compressor 2, the four-way valve 3, the outdoor heat exchanger 4, the capillary tube 5, the first electronic expansion valve 11, the intermediate-pressure receiver 12, and the second electronic expansion valve 13) constituting the outdoor unit 1 and the indoor heat exchanger 9 are sequentially connected by refrigerant pipes. These refrigerant pipes are filled with, for example, R410A, which is an HFC-based refrigerant, so that a refrigeration cycle is formed. Furthermore, an outdoor-heat-exchanger charge port 14 serving as an outdoor-heat-exchanger refrigerant injection port is provided between the four-way valve 3 and the outdoor heat exchanger 4, and a receiver charge port 15 serving as an excess-refrigerant-container refrigerant injection port is provided between the intermediate-pressure receiver 12 and the second electronic expansion valve 13. The refrigerant is injected into the refrigerant circuit via the outdoor-heat-exchanger charge port 14 and the receiver charge port 15. Fans 7 and 10 are provided near the outdoor heat exchanger 4 and the indoor heat exchanger 9 and send outdoor air and indoor air to the outdoor heat exchanger 4 and the indoor heat exchanger 9, respectively, so as to make the refrigerant and the air exchange heat with each other at the outdoor heat exchanger 4 and the indoor heat exchanger 9. In the drawing, arrows denote the circulating direction of the refrigerant. Specifically, solid-line arrows correspond to the case where an indoor cooling operation is performed, whereas dotted-line arrows correspond to the case where an indoor heating operation is performed. When this air-conditioning apparatus is performing a cooling operation or a heating operation, the outdoor-heat-exchanger charge port 14 and the receiver charge port 15 are closed and are not involved with the operation of the refrigeration cycle.

Figure 2:
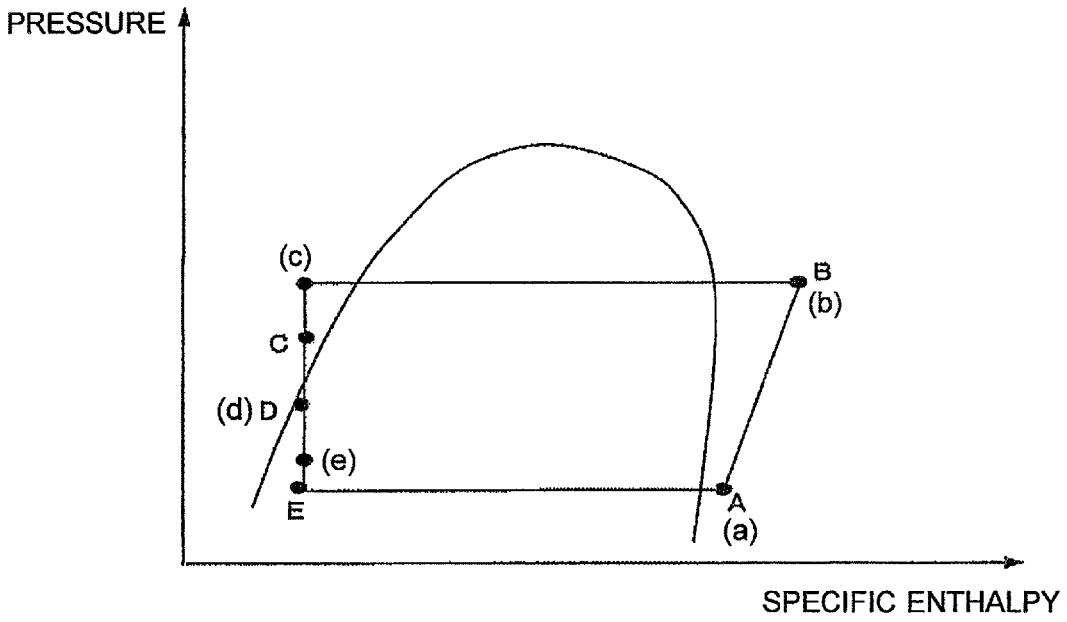
FIG. 2 is a pressure-versus-specific-enthalpy graph of a refrigeration cycle according to Embodiment 1 of the present invention.

FIG. 2 is a pressure-versus-specific-enthalpy graph of the refrigeration cycle according to Embodiment 1. The following description based on FIGS. 1 and 2 relates to the refrigeration cycle in the case where the air-conditioning apparatus is in operation. In FIG. 2, the abscissa axis denotes the specific enthalpy, whereas the ordinate axis denotes the pressure. In the case where an indoor cooling operation is performed, black dots (A, B, C, D, and E) indicate the state of the refrigerant at positions denoted by black dots (A, B, C, D, and E), respectively, in FIG. 1. In the case where a heating operation is performed, black dots (a, b, c, d, and e) indicate the state of the refrigerant at positions denoted by black dots (a, b, c, d, and e), respectively, in FIG. 1.

The cooling operation will be described below. The indoor heat exchanger 9 contained in the indoor unit 8 operates as an evaporator, and the outdoor heat exchanger 4 contained in the outdoor unit 1 operates as a condenser. A low-temperature low-pressure refrigerant (A) is suctioned into the compressor 2 and is discharged therefrom as a high-temperature high-pressure gas refrigerant (B). Subsequently, the high-temperature high-pressure gas refrigerant (B) travels through the four-way valve 3 and transfers heat to outdoor air sent by the fan 7 by exchanging heat with the outdoor air at the outdoor heat exchanger 4 serving as a condenser, so that the temperature of the refrigerant itself decreases. Then, the refrigerant is slightly reduced in pressure (C) by the capillary tube 5 disposed at the outlet of the outdoor heat exchanger 4, and is further reduced in pressure by the first electronic expansion valve 11, thereby becoming an intermediate-temperature intermediate-pressure two-phase gas-liquid refrigerant (D). This intermediate-temperature intermediate-pressure refrigerant (D) flows into the intermediate-pressure receiver 12, and a portion of the refrigerant is retained therein in accordance with the opening degree of the second electronic expansion valve 13, whereas the remaining portion of the refrigerant flows out from the intermediate-pressure receiver 12 and is reduced in pressure by the second electronic expansion valve 13 so as to become a low-temperature low-pressure refrigerant (E), which then circulates from the outdoor unit 1 to the indoor unit 8. In the indoor unit 8, the refrigerant removes heat from indoor air sent by the fan 10 by exchanging heat with the indoor air at the indoor heat exchanger 9 operating as an evaporator, whereby indoor cooling is performed at this point. The refrigerant flowing out from the indoor unit 8 flows into the outdoor unit 1 again, travels through the four-way valve 3, and is suctioned into the compressor 2 again as a low-temperature low-pressure refrigerant (A). The above-described series of cycle is repeated.

In the case of the heating operation, the four-way valve 3 is switched so that the refrigerant flows through a circuit denoted by dotted lines in the four-way valve 3. The refrigerant discharged from the compressor 2 travels through the four-way valve 3 so as to flow to the indoor unit 8. The indoor heat exchanger 9 operates as a condenser, whereas the outdoor heat exchanger 4 operates as an evaporator. Specifically, the refrigerant circulates through the refrigerant circuit in a direction inverse to that in the cooling operation so that indoor heating is performed. The changes in the state of the refrigeration cycle are the same as those in the cooling operation. In the indoor heat exchanger 9, the refrigerant transfers heat to indoor air so that the state of the refrigerant changes from (b) to (c). Subsequently, the refrigerant is reduced to intermediate pressure by the second electronic expansion valve 13, and an intermediate-temperature intermediate-pressure refrigerant (d) is retained in the intermediate-pressure receiver 12. The refrigerant flowing out from the intermediate-pressure receiver 12 is reduced to a low pressure (e) by the first electronic expansion valve 11 and flows into the outdoor heat exchanger 4 via the capillary tube 5. Then, after exchanging heat with outdoor air, the refrigerant becomes a low-temperature low-pressure refrigerant (a), which is then suctioned into the compressor 2.

The volume and the operational state of the indoor unit 8 vary depending on, for example, users' environment. Therefore, a configuration that allows not only a predetermined indoor unit but also an indoor unit with a different volume or a different number of indoor units to be connectable to a single outdoor unit is demanded. In that case, since the capacity of and the amount of air for the indoor heat exchanger vary from indoor unit to indoor unit, the amount of refrigerant required for allowing the refrigeration cycle to exhibit maximum performance would also vary. In addition, the amount of required refrigerant differs between the heating operation and the cooling operation. In Embodiment 1, in order to properly adjust the amount of refrigerant circulating through the refrigerant circuit, the intermediate-pressure receiver 12 is provided as an excess-refrigerant container, and this intermediate-pressure receiver 12 is configured to retain an excess refrigerant in an intermediate-temperature intermediate-pressure state during operation.

In the refrigeration cycle, the condensing temperature and the evaporating temperature of the refrigerant will respectively be referred to as "high temperature" and "low temperature", and the condensing pressure and the evaporating pressure of the refrigerant will respectively be referred to as "high pressure" and "low pressure". An intermediate temperature is a temperature that is lower than the condensing temperature of the refrigerant but higher than the evaporating temperature, and an intermediate pressure is a pressure that is lower than the condensing pressure of the refrigerant but higher than the evaporating pressure. Specifically, the temperature and the pressure of the refrigerant retained in the intermediate-pressure receiver 12 vary depending on the refrigerant circulating through the refrigerant circuit.

The intermediate-pressure receiver 12 is provided at a position that is located between the outdoor heat exchanger 4 and the indoor unit 8 and where an intermediate-pressure liquid refrigerant exists. In detail, a refrigerant flowing out from a heat exchanger operating as a condenser is reduced in pressure in two stages by at least two pressure-reducing means, that is, the first electronic expansion valve 11 and the second electronic expansion valve 13, and an intermediate-temperature intermediate-pressure refrigerant after being reduced in pressure by the upstream-side pressure-reducing means (i.e., the first electronic expansion valve 11 during cooling or the second electronic expansion valve 13 during heating) is retained in the intermediate-pressure receiver 12. Specifically, by disposing the first electronic expansion valve 11 and the second electronic expansion valve 13 in front of and behind the intermediate-pressure receiver 12, the intermediate-temperature intermediate-pressure refrigerant can be retained in the intermediate-pressure receiver 12 even if the circulating direction of the refrigerant flowing through the refrigerant pipes is reversed between the cooling operation and the heating operation.

With the intermediate-pressure receiver 12 provided between the first electronic expansion valve 11 and the second electronic expansion valve 13, the electronic expansion valve located upstream of the intermediate-pressure receiver 12 in the circulating direction of the refrigerant (i.e., the first electronic expansion valve 11 during cooling or the second electronic expansion valve 13 during heating) reduces the pressure of a high-pressure refrigerant to an intermediate pressure. Furthermore, the opening degree of the electronic expansion valve located downstream of the intermediate-pressure receiver 12 in the circulating direction of the refrigerant (i.e., the second electronic expansion valve 13 during cooling or the first electronic expansion valve 11 during heating) is adjusted so that the intermediate-pressure refrigerant is reduced to a low pressure and the amount of liquid refrigerant retained in the intermediate-pressure receiver 12 is optimized. For example, when a container that retains an excess refrigerant is installed at a position where a high-temperature refrigerant may possibly flow into the container, it is desired that the container have high resistance to pressure. In Embodiment 1, since an intermediate-temperature intermediate pressure refrigerant (D or d) reduced in pressure by an electronic expansion valve provided upstream of the intermediate-pressure receiver 12 is retained in the intermediate-pressure receiver 12, a refrigerant reduced in pressure to some extent is made to flow into the intermediate-pressure receiver 12. This allows for improved reliability without requiring the pressure resistance as in the configuration that retains a high-pressure refrigerant.

The following description relates to a case where a refrigerant is injected into the refrigerant circuit of the air-conditioning apparatus during production thereof. In view of the volumes (capacities) of the devices constituting the air-conditioning apparatus, the outdoor heat exchanger 4 normally has the largest volume, the intermediate-pressure receiver 12 has the second largest volume, and then the indoor heat exchanger 9 and the compressor 2 and so on. For example, the outdoor heat exchanger 4 has a volume of about 5000 cc, the intermediate-pressure receiver 12 has a volume of about 3000 cc, the indoor heat exchanger 9 has a volume of about 500 to 1000 cc, and the compressor 2 has a volume of about 500 cc. In particular, in a separate-type air-conditioning apparatus in which the indoor unit 8 and the outdoor unit 1 are separated from each other, a refrigerant is injected into the outdoor unit 1 in advance at a factory, etc. At an installation location, operation is performed after connecting the indoor unit 8 to the refrigerant pipes of the outdoor unit 1. This allows for a safe and easy process in view of assembly and installation. Therefore, upon injection of a refrigerant into the outdoor unit 1, a large amount of refrigerant that can cover the entire refrigerant circuit is injected, meaning that a sufficient amount of refrigerant that at least fills the outdoor heat exchanger 4 and the intermediate-pressure receiver 12 having large capacities needs to be reliably injected. In addition, the refrigerant needs to be injected in a well-balanced manner in accordance with the capacities of the outdoor heat exchanger 4 and the intermediate-pressure receiver 12.

Figure 3:
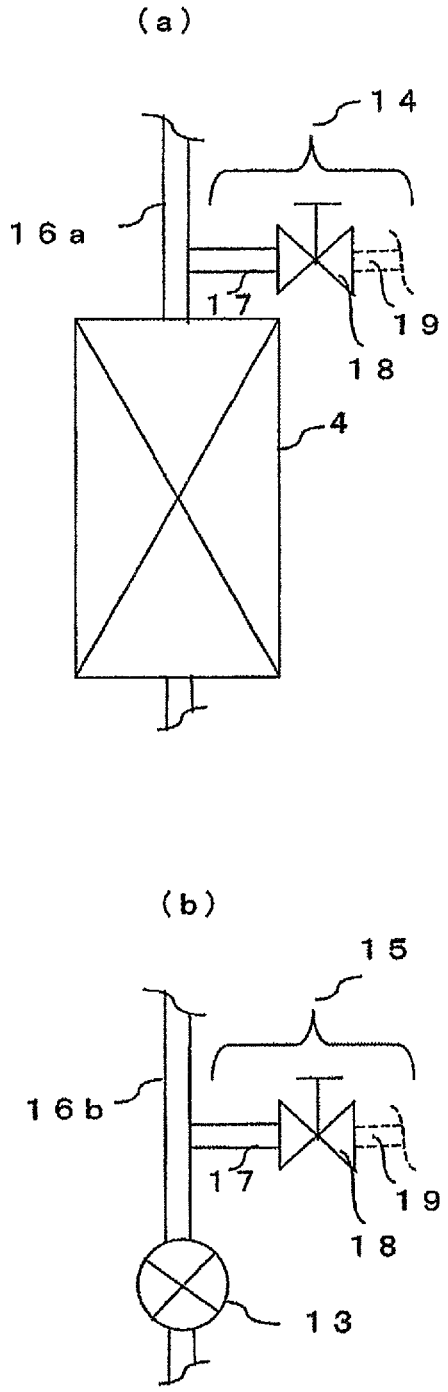
FIG. 3 includes schematic diagrams illustrating refrigerant injection ports according to Embodiment 1 of the present invention.

FIG. 3 includes schematic diagrams illustrating an example of the outdoor-heat-exchanger charge port 14 serving as an outdoor-heat-exchanger refrigerant injection port and the receiver charge port 15 serving as an intermediate-receiver refrigerant injection port, which are used for injecting a refrigerant into the refrigerant circuit. FIG. 3(*a*) illustrates the outdoor-heat-exchanger charge port 14 provided in a refrigerant pipe 16*a* that is directly connected to the outdoor heat exchanger 4. To the refrigerant pipe 16*a* is connected a branch pipe 17 whose one end is connected to a valve 18 having an opening-and-closing function. The valve 18 is opened and is attached to, for example, a refrigerant pipe 19 or a refrigerant hose (denoted by a dotted line) connected to a refrigerant container (not shown) so that the refrigerant in the refrigerant container is injected into the outdoor heat exchanger 4 from the refrigerant pipe 16*a* via the refrigerant pipe 19, the valve 18, and the branch pipe 17. After injecting the refrigerant, the valve 18 is closed.

The refrigerant pipe directly connected to the outdoor heat exchanger 4 is a refrigerant pipe that is connected to a pipe in the outdoor heat exchanger 4 without any intervening devices that are constituent of e the refrigerant circuit, for example, pressure-reducing members such as the capillary tube 5 and the electronic expansion valves 11 and 13. The outdoor-heat-exchanger charge port 14 is connected to the outdoor heat exchanger 4 only via the refrigerant pipe.

The receiver charge port 15 provided in a refrigerant pipe 16*b* that is directly connected to the intermediate-pressure receiver 12 has a similar configuration. In FIG. 3(*b*), a branch pipe 17 whose one end is connected to a valve 18 having an opening-and-closing function is connected to the refrigerant pipe 16*b* directly connected to the intermediate-pressure receiver 12. This valve 18 is opened and, for example, a refrigerant pipe 19 (denoted by a dotted line) connected to a refrigerant container (not shown) is attached to the valve 18 so that the refrigerant in the refrigerant container is injected into the intermediate-pressure receiver 12 from the refrigerant pipe 16*b* via the refrigerant pipe 19, the valve 18, and the branch pipe 17. After injection of the refrigerant, the valve 18 is closed.

Similar to the above, the refrigerant pipe directly connected to the intermediate-pressure receiver 12 is a refrigerant pipe that is connected to a pipe in the intermediate-pressure receiver 12 without any intervening devices that are the constituents of the refrigerant circuit, for example, pressure-reducing members such as the capillary tube 5 and the electronic expansion valves 11 and 13. The receiver charge port 15 is connected to the intermediate-pressure receiver 12 only via the refrigerant pipe.

In a configuration provided with a single charge port in the entire refrigerant circuit, as in the apparatus in the conventional art, for example, if the refrigerant is to be injected into the refrigerant circuit from the charge port 14 provided near the outdoor heat exchanger 4, the existence of the capillary tube 5 and the first electronic expansion valve 11 serving as pressure-reducing members creates resistance that makes it difficult for the refrigerant to move and flow into the intermediate-pressure receiver 12, causing most of the refrigerant to be retained in the outdoor heat exchanger 4. Because the upstream side and the downstream side of the intermediate-pressure receiver 12 are respectively connected to the electronic expansion valves 11 and 13, it is difficult to inject the refrigerant into the intermediate-pressure receiver 12 if the charge port is provided near the outdoor heat exchanger 4, or it is difficult to inject the refrigerant into the outdoor heat exchanger 4 if the charge port is provided near the intermediate-pressure receiver 12. Although the refrigerant may gradually flow into the intermediate-pressure receiver 12 or the outdoor heat exchanger 4 by passing through the pressure-reducing members, the injection time is too long.

In contrast, in Embodiment 1, the refrigerant is reliably injected into the outdoor heat exchanger 4 from the outdoor-heat-exchanger charge port 14. Furthermore, since there are no pressure-reducing members between the outdoor-heat-exchanger charge port 14 and the outdoor heat exchanger 4, the refrigerant is injected smoothly within a short period of time. Likewise, the refrigerant is reliably injected into the intermediate-pressure receiver 12 from the receiver charge port 15, and since there are no pressure-reducing members between the receiver charge port 15 and the intermediate-pressure receiver 12, the refrigerant is injected smoothly within a short period of time. Accordingly, since an amount of refrigerant required in the refrigerant circuit is distributively injected into the outdoor heat exchanger 4 and the intermediate-pressure receiver 12, the occurrence of a liquid-sealed state caused by the refrigerant being injected lopsidedly to a specific device in the refrigerant circuit is prevented, whereby the refrigerant is safely injected.

Furthermore, a required amount of refrigerant can be injected from the outdoor-heat-exchanger charge port 14 in accordance with the capacity of the outdoor heat exchanger 4. Likewise, a required amount of refrigerant can be injected from the receiver charge port 15 in accordance with the capacity of the intermediate-pressure receiver 12. Therefore, an amount of refrigerant required in the refrigerant circuit can be distributively injected into the outdoor heat exchanger 4 and the intermediate-pressure receiver 12 in a well-balanced manner. Accordingly, a required amount of refrigerant can be injected in accordance with the different capacities of the outdoor heat exchanger 4 and the intermediate-pressure receiver 12 constituting the refrigerant circuit.

Either of the refrigerant injection processes may precede the other. For example, the refrigerant may be injected into the intermediate-pressure receiver 12 from the receiver charge port 15 after the injection of the refrigerant into the outdoor heat exchanger 4 from the outdoor-heat-exchanger charge port 14. Alternatively, the refrigerant may be injected into the outdoor heat exchanger 4 from the outdoor-heat-exchanger charge port 14 after the injection of the refrigerant into the intermediate-pressure receiver 12 from the receiver charge port 15. Furthermore, injecting the refrigerant simultaneously into the intermediate-pressure receiver 12 and the outdoor heat exchanger 4 shortens the time required for the refrigerant injection process.

The configurations of the outdoor-heat-exchanger charge port 14 and the receiver charge port 15 are not limited to those described above, and alternative configurations are permissible. For example, if the refrigerant is to be preliminarily injected into the refrigerant circuit during the manufacturing process, the branch pipes may simply be connected to the refrigerant pipes and be closed by, for example, brazing after the refrigerant is injected through these branch pipes. In this case, if an injection is necessary again, the injection process can be performed again by cutting the brazed sections.

Accordingly, the outdoor-heat-exchanger charge port 14 is provided in the refrigerant pipe that is directly connected to the large-capacity outdoor heat exchanger 4 constituting the refrigerant circuit, and the receiver charge port 15 is provided in the refrigerant pipe that is directly connected to the intermediate-pressure receiver 12, so that the refrigerant can be reliably injected into the outdoor heat exchanger 4 and the intermediate-pressure receiver 12, thereby allowing for improved reliability of the refrigerant injection process and also achieving a shorter injection time. In particular, an amount of refrigerant required in the refrigerant circuit can be injected thereto at the outdoor-unit side. Although the refrigerant injection process performed during the manufacturing process is described above, the present invention is not limited to this. For example, even if there is a need to additionally inject the refrigerant into the refrigerant circuit after installation, an amount of refrigerant required in the refrigerant circuit can be injected from the outdoor-heat-exchanger charge port 14 and the receiver charge port 15, whereby the refrigerant can be injected reliably in a well-balanced manner within a short period of time, advantageously.

According to Embodiment 1, the air-conditioning apparatus includes the outdoor unit 1 having outdoor devices, which include the compressor 2 that compresses the refrigerant, the flow switching valve 3 that switches the flowing direction of the refrigerant, the outdoor heat exchanger 4 that exchanges heat between the refrigerant and outdoor air, the first expansion valve 11 that reduces the pressure of the refrigerant, the excess-refrigerant container 12 that retains an excess refrigerant of the refrigerant, and the second expansion valve 13 that reduces the pressure of the refrigerant; and the indoor unit 8 having the indoor heat exchanger 9 that exchanges heat between the refrigerant and indoor air. The outdoor devices and the indoor heat exchanger 9 are sequentially connected by the refrigerant pipes so that a refrigeration cycle is formed. The air-conditioning apparatus further includes the outdoor-heat-exchanger refrigerant injection port 14 provided in the refrigerant pipe 16*a* that is directly connected to the outdoor heat exchanger 4, and the excess-refrigerant-container refrigerant injection port 15 provided in the refrigerant pipe 16*b* that is directly connected to the excess-refrigerant container 12. Thus, the refrigerant can also be injected into the large-capacity excess-refrigerant container 12 in a well-balanced manner without a large amount of refrigerant being lopsidedly injected only into the outdoor heat exchanger 4. Consequently, an air-conditioning apparatus is provided in which an amount of refrigerant required in the refrigerant circuit can be reliably and safely injected thereto within a short period of time, advantageously.

Figure 4:
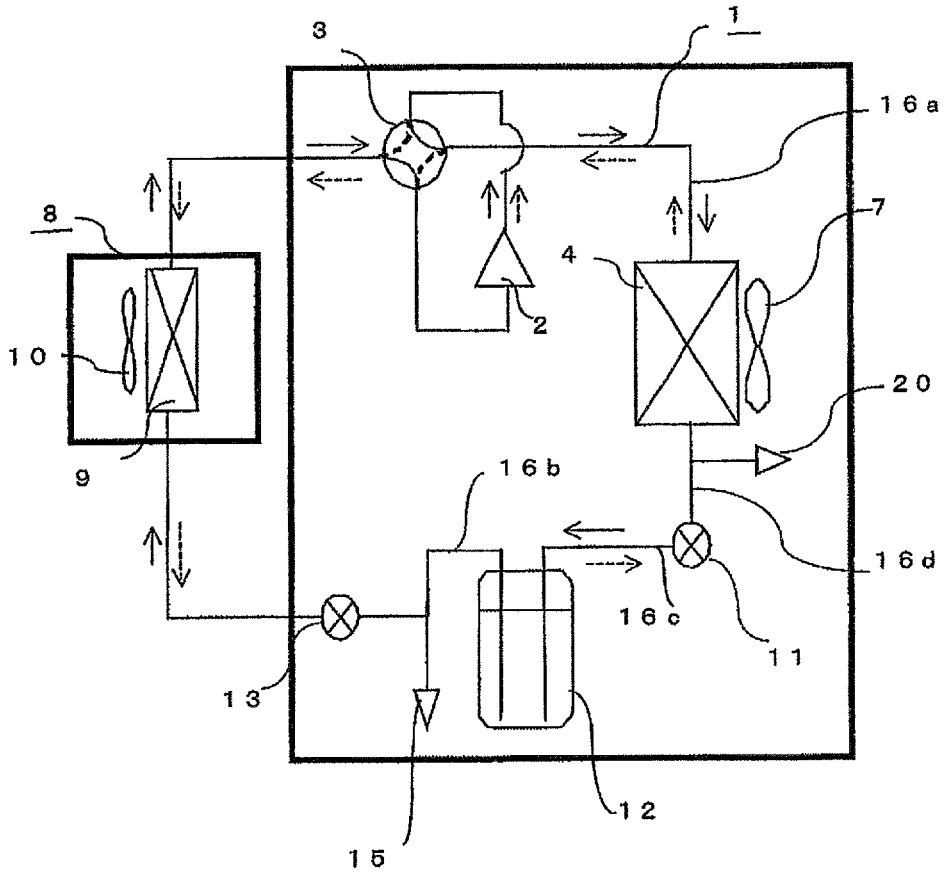
FIG. 4 is a schematic diagram illustrating another exemplary configuration of the air-conditioning apparatus according to Embodiment 1 of the present invention.

FIG. 4 is a schematic diagram illustrating another exemplary configuration of the air-conditioning apparatus according to the present invention. With regard to the position of the outdoor-heat-exchanger charge port, in the configuration in FIG. 1, the outdoor-heat-exchanger charge port 14 is provided in the refrigerant pipe 16*a* that serves as a refrigerant pipe directly connected to the outdoor heat exchanger 4 and that extends between the four-way valve 3 and the outdoor heat exchanger 4. In the exemplary configuration shown in FIG. 4, a capillary tube is not provided between the outdoor heat exchanger 4 and the first electronic expansion valve 11, and an outdoor-heat-exchanger charge port 20 is provided in a refrigerant pipe 16*d* extending between the outdoor heat exchanger 4 and the first electronic expansion valve 11.

This configuration is similar to that in FIG. 1 in that the refrigerant can be injected into the outdoor heat exchanger 4 from the outdoor-heat-exchanger charge port 20 and in that the refrigerant can be injected into the intermediate-pressure receiver 12 from the receiver charge port 15. A required amount of refrigerant can be reliably injected in a well-balanced manner without the refrigerant being lopsided to one of the outdoor heat exchanger 4 and the intermediate-pressure receiver 12, which are large-capacity devices among the devices constituting the outdoor unit 1, thereby allowing for improved reliability of the refrigerant injection process and also achieving a shorter injection time.

Figure 5:
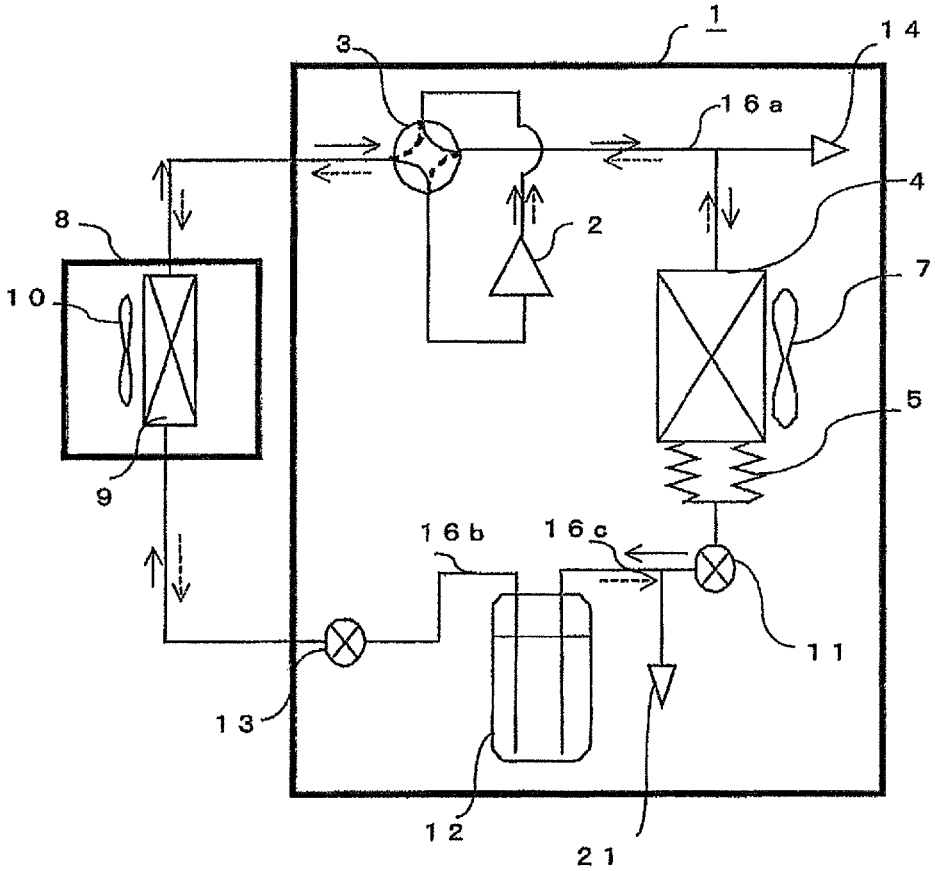
FIG. 5 is a schematic diagram illustrating another exemplary configuration of the air-conditioning apparatus according to Embodiment 1 of the present invention.

FIG. 5 is a schematic diagram illustrating another exemplary configuration of the air-conditioning apparatus according to the present invention. With regard to the position of the receiver charge port, in the configurations in FIG. 1 and FIG. 4, the receiver charge port 15 is provided in the refrigerant pipe 16*b* that serves as a refrigerant pipe directly connected to the intermediate-pressure receiver 12 and that extends between the intermediate-pressure receiver 12 and the second electronic expansion valve 13. In the exemplary configuration shown in FIG. 5, a receiver charge port 21 is provided in a refrigerant pipe 16*c* extending between the first electronic expansion valve 11 and the intermediate-pressure receiver 12.

This configuration is similar to that in FIG. 1 in that the refrigerant can be injected into the outdoor heat exchanger 4 from the outdoor-heat-exchanger charge port 14 and in that the refrigerant can be injected into the intermediate-pressure receiver 12 from the receiver charge port 21. A required amount of refrigerant can be reliably injected in a well-balanced manner without the refrigerant being lopsided to one of the outdoor heat exchanger 4 and the intermediate-pressure receiver 12, which are large-capacity devices among the devices constituting the outdoor unit 1, thereby allowing for improved reliability of the refrigerant injection process and also achieving a shorter injection time.

By providing the receiver charge port 21 in the refrigerant pipe 16*c* extending between the first electronic expansion valve 11 and the intermediate-pressure receiver 12 in the configuration in FIG. 4, a similar advantage can be achieved.

Figure 6:
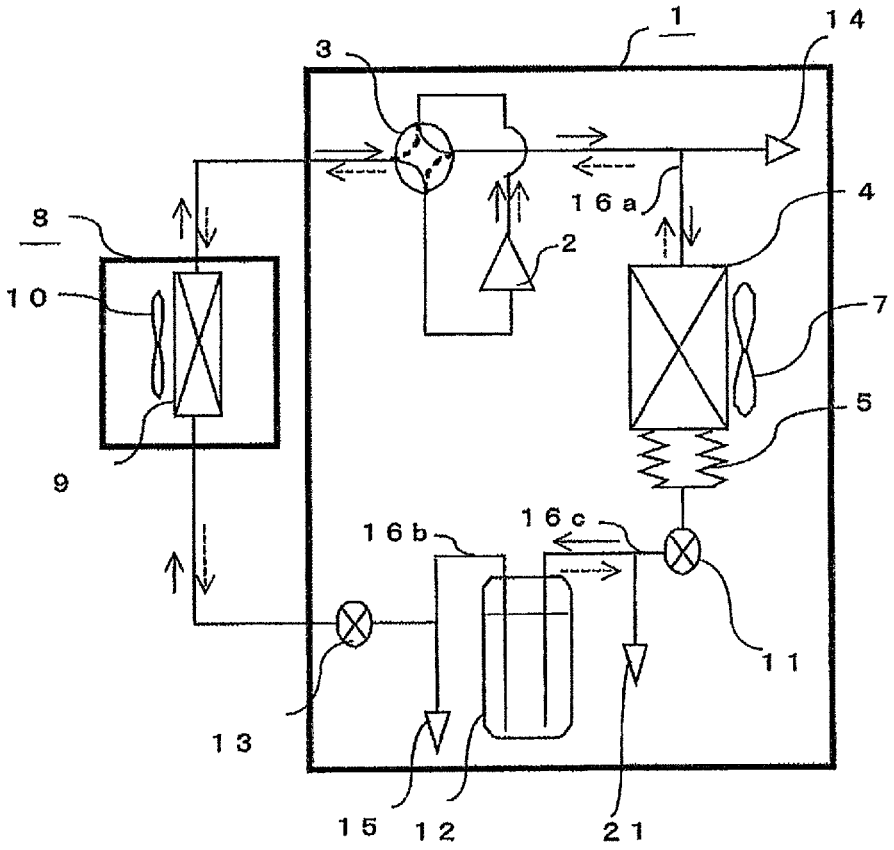
FIG. 6 is a schematic diagram illustrating another exemplary configuration of the air-conditioning apparatus according to Embodiment 1 of the present invention.

FIG. 6 is a schematic diagram illustrating another exemplary configuration of the air-conditioning apparatus according to the present invention. In this exemplary configuration, three charge ports 14, 15, and 21 are provided. Specifically, the outdoor-heat-exchanger charge port 14 is provided in the refrigerant pipe 16*a* directly connected to the outdoor heat exchanger 4, the receiver charge port 15 is provided in one refrigerant pipe 16*b* directly connected to the intermediate-pressure receiver 12, and the receiver charge port 21 is provided in the other refrigerant pipe 16*c* directly connected to the intermediate-pressure receiver 12. The refrigerant is injected into the outdoor heat exchanger 4 from the outdoor-heat-exchanger charge port 14, and the refrigerant is injected into the intermediate-pressure receiver 12 from the two receiver charge ports 15 and 21. In this exemplary configuration, because the refrigerant can be injected into the intermediate-pressure receiver 12 simultaneously from the two receiver charge ports 15 and 21, the time required for the process of filling the intermediate-pressure receiver 12 with the refrigerant can be shortened, whereby a sufficient amount of refrigerant can be reliably injected into the refrigerant circuit.

Furthermore, in the case where the outdoor heat exchanger 4 and the first electronic expansion valve 11 are connected by the refrigerant pipe 16*d* as in FIG. 4, two outdoor-heat-exchanger charge ports 14 and 20 may be provided. By injection of the refrigerant into the outdoor heat exchanger 4 from the two outdoor-heat-exchanger charge ports 14 and 20, the time required for the process of filling the outdoor heat exchanger 4 with the refrigerant can be shortened, whereby a sufficient amount of refrigerant can be reliably injected into the refrigerant circuit.

According to Embodiment 1, the excess-refrigerant-container refrigerant injection port 15 or 21 is provided for both or at least either one of the refrigerant pipe 16*c*, extending between the first expansion valve 11 and the excess-refrigerant container 12, and the refrigerant pipe 16*b*, extending between the second expansion valve 13 and the excess-refrigerant container 12, whereby an air-conditioning apparatus is obtained in which a required amount of refrigerant can be reliably injected into the intermediate-pressure receiver 12 within a short period of time, advantageously.

Furthermore, the outdoor-heat-exchanger refrigerant injection port 14 or 20 is provided for at least one of or each of the refrigerant pipe 16*a* extending between the flow switching valve 3 and the outdoor heat exchanger 4 and the refrigerant pipe 16*d* extending between the first expansion valve 11 and the outdoor heat exchanger 4, whereby an air-conditioning apparatus is obtained in which a required amount of refrigerant can be reliably injected into the outdoor heat exchanger 4 within a short period of time, advantageously.

Embodiment 2

Figure 7:
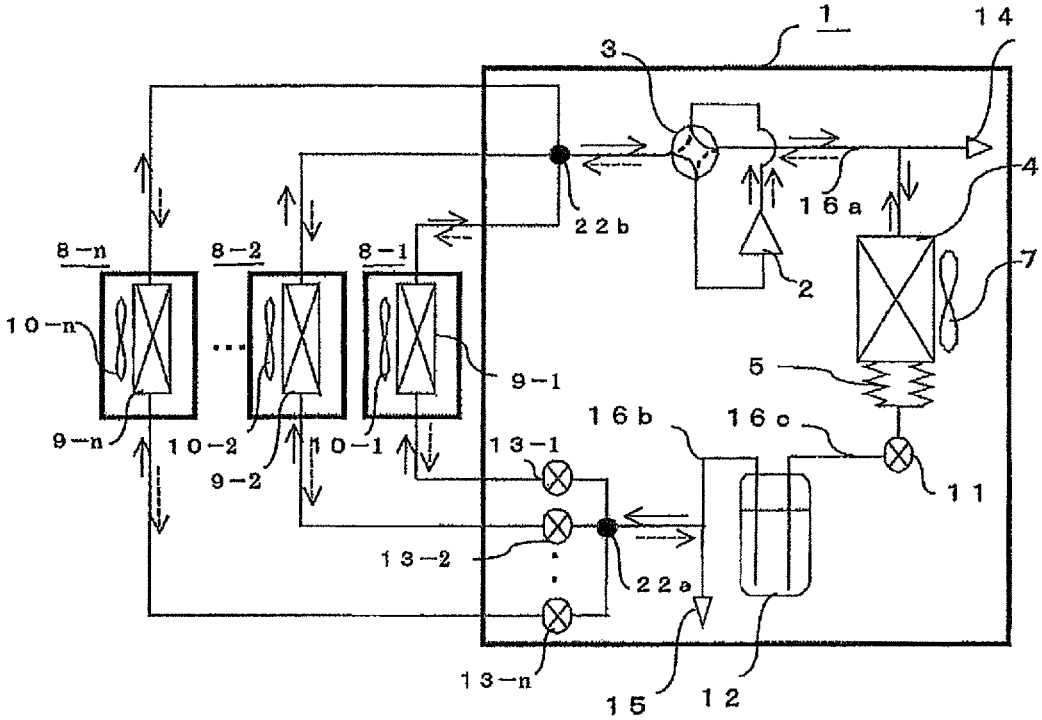
FIG. 7 is a schematic diagram illustrating a refrigerant circuit of an air-conditioning apparatus according to Embodiment 2 of the present invention.

FIG. 7 is a schematic diagram illustrating a refrigerant circuit of an air-conditioning apparatus according to Embodiment 2 of the present invention. In the drawing, reference numerals or characters that are the same as those in FIG. 1 denote the same or equivalent components. The configuration of Embodiment 2 is one to which a plurality of, that is, n (which is an integer greater than 1) number of indoor units 8-1 to 8-*n* are connectable. In the configuration, branch sections 22*a* and 22*b* of the refrigerant circuit are provided in the outdoor unit 1, and n number of second electronic expansion valves 13-1 to 13-*n* that respectively correspond to the indoor units 8-1 to 8-*n* are provided. In this case, the outdoor-heat-exchanger charge port 14 is provided in the refrigerant pipe 16*a* that is directly connected to the outdoor heat exchanger 4, and the receiver charge port 15 is provided in the refrigerant pipe 16*b* that is directly connected to the intermediate-pressure receiver 12. In the drawing, solid-line arrows denote the circulating direction of the refrigerant when a cooling operation is performed by the indoor units 8, and dotted-line arrows denote the circulating direction of the refrigerant when a heating operation is performed by the indoor units 8.

In the case where the plurality of indoor units 8-1 to 8-*n* are provided, indoor heat exchangers 9-1 to 9-*n* provided therein are connected in parallel to the outdoor heat exchanger 4, and the refrigerant pipes are ramified into n number of refrigerant pipes at the branch sections 22*a* and 22*b*. The amount of refrigerant flowing through the indoor heat exchangers 9-1 to 9-*n* is adjusted by the second electronic expansion valves 13-1 to 13-*n* provided in the respective refrigerant pipes.

Because the configuration according to Embodiment 2 is provided with the plurality of indoor units 8-1 to 8-*n*, a larger amount of refrigerant is required in the refrigerant circuit that achieves this configuration, as compared with that in Embodiment 1. For example, if all of the indoor units 8-1 to 8-*n* operate at the same time, the outdoor unit 1 would be constituted of an outdoor heat exchanger 4 with a large capacity in correspondence with the plurality of indoor heat exchangers 9-1 to 9-*n* in operation. Therefore, the amount of refrigerant required in the refrigerant circuit is larger than that in the configuration provided with a single indoor unit 8, meaning that a large amount of refrigerant is injected into the refrigerant circuit. However, there is also a case where only one of the indoor units 8-1 to 8-*n* operates. In this case, the amount of refrigerant circulating through the refrigerant circuit is small, resulting in a large amount of excess refrigerant. For this reason, a large amount of excess refrigerant becomes retained in the intermediate-pressure receiver 12, making it necessary for the intermediate-pressure receiver 12 to have a large capacity. Specifically, in the air-conditioning apparatus equipped with the plurality of indoor units 8-1 to 8-*n*, the outdoor heat exchanger 4 and the intermediate-pressure receiver 12 provided have larger capacities than those in the configuration in FIG. 1.

In the air-conditioning apparatus equipped with the outdoor heat exchanger 4 and the intermediate-pressure receiver 12 that have large capacities, the refrigerant is injected into the outdoor heat exchanger 4 from the outdoor-heat-exchanger charge port 14 provided in the refrigerant pipe 16*a* directly connected to the outdoor heat exchanger 4, and the refrigerant is injected into the intermediate-pressure receiver 12 from the receiver charge port 15 provided in the refrigerant pipe 16*b* directly connected to the intermediate-pressure receiver 12. By injecting the refrigerant into the outdoor heat exchanger 4 and the intermediate-pressure receiver 12 constituting the outdoor unit 1 in this manner, an amount of refrigerant required in the refrigerant circuit can be reliably injected thereto in a well-balanced manner in accordance with the capacities of the outdoor heat exchanger 4 and the intermediate-pressure receiver 12. Therefore, because of absence of a liquid-sealed state being caused, the safety of the refrigerant injection process can be ensured, the reliability thereof can be improved, and a shorter refrigerant injection time can be achieved. Furthermore, by injecting the refrigerant simultaneously into the intermediate-pressure receiver 12 and the outdoor heat exchanger 4, the refrigerant injection time can be further shortened.

Accordingly, with the plurality of indoor units 8-1 to 8-*n* provided in Embodiment 2, an outdoor unit 1 is obtained that can comply with various configurations, so that an air-conditioning apparatus in which an amount of refrigerant required in the refrigerant circuit can be reliably and safely injected thereto within a short period of time at the outdoor-unit side, advantageously.

Embodiment 3

Figure 8:
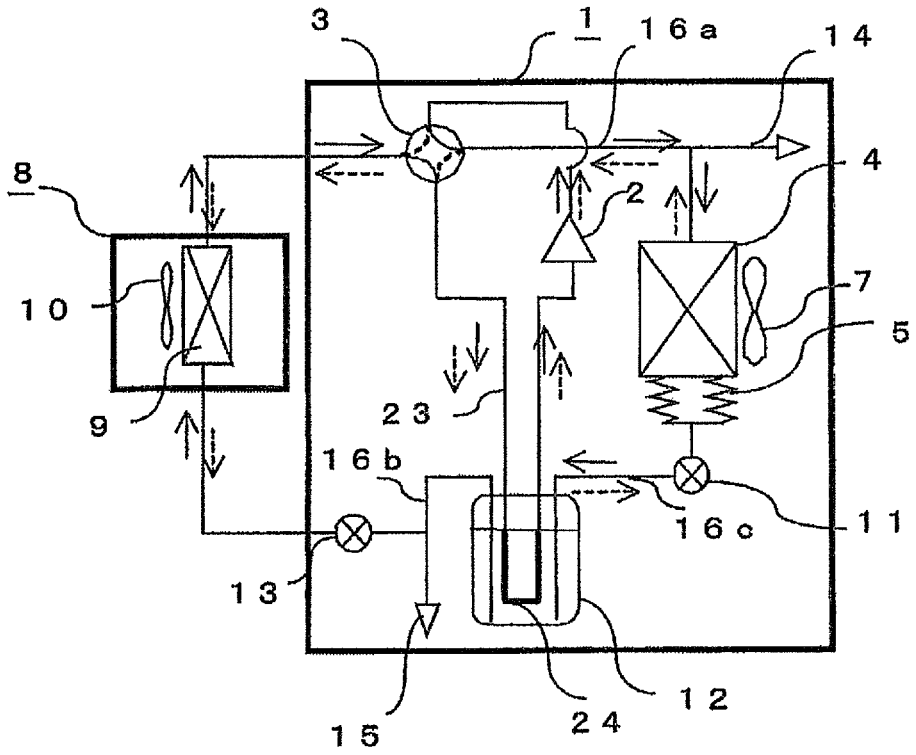
FIG. 8 is a schematic diagram illustrating a refrigerant circuit of an air-conditioning apparatus according to Embodiment 3 of the present invention.

FIG. 8 is a schematic diagram illustrating a refrigerant circuit of an air-conditioning apparatus according to Embodiment 3 of the present invention. In the drawing, reference numerals or characters that are the same as those in FIG. 1 denote the same or equivalent components. In Embodiment 3, a heat exchanging unit 24 where the refrigerant flowing through a refrigerant pipe 23 (this refrigerant pipe 23 will be referred to as "suction pipe") connected to the suction side of the compressor 2 exchanges heat with the refrigerant retained in the intermediate-pressure receiver 12 serving as an excess-refrigerant container is provided. The heat exchanging unit 24 is configured such that the suction pipe 23 extends through the liquid refrigerant retained in the intermediate-pressure receiver 12. Although the refrigerant pipe in the heat exchanging unit 24 is indicated by a thick line in the drawing to provide an easier understanding of the heat exchanging unit 24, the refrigerant pipe may have a same or similar thickness or diameter as the other refrigerant pipes in an actual configuration.

Figure 9:
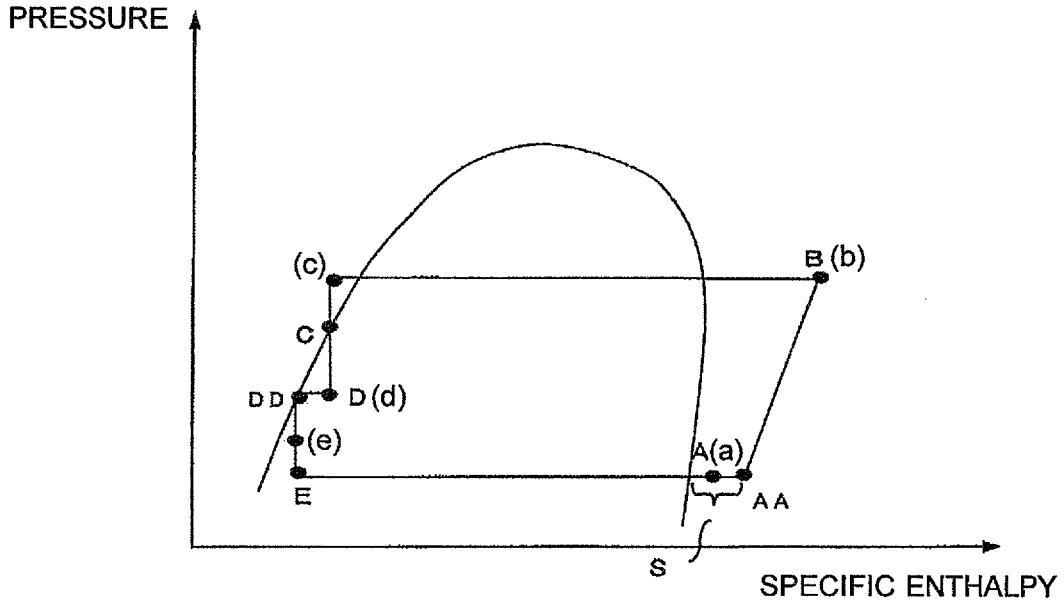
FIG. 9 is a pressure-versus-specific-enthalpy graph of a refrigeration cycle according to Embodiment 3 of the present invention.

A low-temperature low-pressure refrigerant in the suction pipe 23 is made to exchange heat with the excess refrigerant retained in the intermediate-pressure receiver 12 by the heat exchanging unit 24 so as to receive heat from the intermediate-temperature intermediate-pressure excess refrigerant retained in the intermediate-pressure receiver 12. Subsequently, the refrigerant is suctioned into the compressor 2. By receiving heat from the intermediate-temperature intermediate-pressure excess refrigerant, the refrigerant at the suction side of the compressor 2 can be reliably turned into a gas state as indicated by AA shown in a pressure-versus-specific-enthalpy diagram in FIG. 9. In other words, superheat (S) at the right side of a saturated vapor line can be ensured for the refrigerant to be suctioned into the compressor 2. If a refrigerant in a liquid state is suctioned into the compressor 2, the compressor 2 may possibly result in a failure, or the efficiency thereof may decrease. In the configuration according to Embodiment 3, since superheat (S) can be ensured so that the refrigerant can be reliably suctioned into the compressor 2 in a gas state, the reliability of the compressor 2 can be improved, and the load on the compressor 2 can be reduced, thereby improving the efficiency. The pressure-versus-specific-enthalpy diagram shown in FIG. 9 is a graph in which the abscissa axis denotes the specific enthalpy and the ordinate axis denotes the pressure. In the graph, D-DD and A-AA denote sections where the refrigerant retained in the intermediate-pressure receiver 12 and the refrigerant flowing through the suction pipe 23 exchange heat with each other at the heat exchanging unit 24 of the intermediate-pressure receiver 12.

In the refrigerant circuit having the intermediate-pressure receiver 12 and also having the heat exchanging unit 24 that exchanges heat between the refrigerant flowing through the suction pipe 23 and the excess refrigerant, as in this configuration, the outdoor-heat-exchanger charge port 14 and the receiver charge port 15 are provided so that the refrigerant can be injected into the outdoor heat exchanger 4 and the intermediate-pressure receiver 12. Thus, the refrigerant can be injected in a well-balanced manner into the outdoor heat exchanger 4 and the intermediate-pressure receiver 12 that have large capacities among the devices contained in and constituting the outdoor unit 1, whereby an air-conditioning apparatus is obtained in which an amount of refrigerant required in the refrigerant circuit can be reliably and safely injected thereto within a short period of time.

In particular, in this configuration, the heat of the excess refrigerant in the intermediate-pressure receiver 12 can be effectively utilized.

According to Embodiment 3, the heat exchanging unit 24 that exchanges heat between the refrigerant flowing through the refrigerant pipe 23 connected to the suction side of the compressor 2 and the refrigerant retained in the excess-refrigerant container 12 is provided, so that the refrigerant to be suctioned into the compressor 2 is suctioned into the compressor 2 after exchanging heat with the refrigerant retained in the excess-refrigerant container 12 at the heat exchanging unit 24. Thus, the heat in the excess-refrigerant container 12 is effectively utilized so that a circuit configuration with improved reliability of the compressor 2 is achieved. In this circuit configuration, the outdoor-heat-exchanger refrigerant injection port 14 and the excess-refrigerant-container refrigerant injection port 15 are provided so that the refrigerant can be injected into the outdoor heat exchanger 4 and the excess-refrigerant container 12. Consequently, the refrigerant can be injected in a well-balanced manner into the outdoor heat exchanger 4 and the excess-refrigerant container 12 that have large capacities among the devices contained in and constituting the outdoor unit 1, whereby an air-conditioning apparatus is obtained in which an amount of refrigerant required in the refrigerant circuit can be reliably and safely injected thereto within a short period of time.

Although the heat exchanging unit 24 is configured such that the suction pipe 23 extends through the refrigerant retained in the intermediate-pressure receiver 12 in FIG. 8, the configuration thereof is not limited to this. For example, the suction pipe 23 may be wound in close contact with the inner wall or the outer wall of the intermediate-pressure receiver 12. Any configuration is permissible so long as the refrigerant to be suctioned into the compressor 2 is suctioned into the compressor 2 after exchanging heat with the excess refrigerant retained in the intermediate-pressure receiver 12.

Similar to Embodiment 1, in Embodiment 2 and Embodiment 3, the charge port 15 may be replaced with a charge port that is provided in the refrigerant pipe 16*c* directly connected to the intermediate-pressure receiver 12, or a charge port may be provided in each of the two refrigerant pipes 16*b* and 16*c* such that the refrigerant is injected into the intermediate-pressure receiver 12 from both charge ports.

Furthermore, the charge port 14 may be replaced with a charge port that is provided in the refrigerant pipe 16*d* (see FIG. 4) directly connected to the outdoor heat exchanger 4, or a charge port may be provided in each of the two refrigerant pipes 16*a* and 16*d* such that the refrigerant is injected into the outdoor heat exchanger 4 from both charge ports. By injection of the refrigerant from a plurality of charge ports, the refrigerant injection time can be further shortened.

REFERENCE SIGNS LIST

1 outdoor unit 2 compressor 3flow switching valve 4 outdoor heat exchanger 5 capillary tube 7 outdoor fan 8, 8-1, 8-2, 8-n indoor unit 9, 9-1, 9-2, 9-n indoor heat exchanger 10 indoor Reference Signs List 1 outdoor unit 2 compressor 3 flow switching valve 4 outdoor heat exchanger 5 capillary tube 7 outdoor fan 8, 8-1, 8-2, 8-n indoor unit 9, 9-1, 9-2, 9-n indoor heat exchanger 10 indoor fan 11 first expansion valve 12 excess-refrigerant container 13, 13-1, 13-2, 13-n second expansion valve 14 outdoor-heat-exchanger refrigerant injection port 15 excess-refrigerant-container refrigerant injection port 16a, 16b, 16c, 16d refrigerant pipe 17 branch pipe 18 on-off valve 19 refrigerant pipe 20 outdoor-heat-exchanger refrigerant injection port 21 excess-refrigerant-container refrigerant injection port 22a, 22b branch section 23 suction pipe 24 heat exchanging unit

The invention claimed is:

1. An air-conditioning apparatus comprising:

an outdoor unit having outdoor devices including a compressor that compresses a refrigerant, a flow switching valve that switches a flowing direction of the refrigerant, an outdoor heat exchanger that exchanges heat between the refrigerant and outdoor air, a first expansion valve that reduces pressure of the refrigerant, an excess-refrigerant container that retains an excess refrigerant of the refrigerant, and a second expansion valve that reduces the pressure of the refrigerant, the compressor, the flow switching valve, the outdoor heat exchanger, the first expansion valve, the excess-refrigerant container, and the second expansion valve being connected in this order; and an indoor unit having an indoor heat exchanger that exchanges heat between the refrigerant and indoor air, wherein the outdoor devices and the indoor heat exchanger are sequentially connected by refrigerant pipes so that a refrigeration cycle is formed, wherein the air-conditioning apparatus further comprises at least one outdoor-heat-exchanger refrigerant injection port provided in a refrigerant pipe that is directly connected to the outdoor heat exchanger, and at least one excess-refrigerant-container refrigerant injection port provided in a refrigerant pipe that is located directly adjacent to the first expansion valve and the excess-refrigerant container, the first expansion valve and the excess-refrigerant container being located on opposing ends of the refrigerant pipe that is located directly adjacent to the first expansion valve and the excess-refrigerant container.

2. The air-conditioning apparatus of claim 1, wherein the at least one excess-refrigerant container refrigerant injection port includes two excess-refrigerant container refrigerant injection ports provided in both the refrigerant pipe that is located directly adjacent to the first expansion valve and the excess-refrigerant container, and in a refrigerant pipe that is located directly adjacent to the second expansion valve and the excess-refrigerant container, the second expansion valve and the excess-refrigerant container being located on opposing ends of the refrigerant pipe that is located directly adjacent to the second expansion valve and the excess-refrigerant container.

3. The air-conditioning apparatus of claim 1, wherein the at least one outdoor-heat-exchanger refrigerant injection port is provided in both or at least either one of a refrigerant pipe that is located directly adjacent to the flow switching valve and the outdoor heat exchanger, the flow switching valve and the outdoor heat exchanger are located on opposing ends of the refrigerant pipe that is located directly adjacent to the flow switching valve and the outdoor heat exchangers, and of a refrigerant pipe that is located directly adjacent to the first expansion valve and the outdoor heat exchanger, the first expansion valve and the outdoor heat exchanger are located on opposing ends of the refrigerant pipe that is located directly adjacent to the first expansion valve and the outdoor heat exchanger.

4. The air-conditioning apparatus of claim 1, wherein the indoor unit comprises a plurality of indoor units.

5. The air-conditioning apparatus of claim 1, further comprising a heat exchanging unit that exchanges heat between the refrigerant flowing through a refrigerant pipe that is connected to a suction side of the compressor and the refrigerant retained in the excess refrigerant container, wherein the refrigerant to be suctioned into the compressor is suctioned into the compressor after exchanging heat with the refrigerant retained in the excess-refrigerant container at the heat exchanging unit.

6. The air-conditioning apparatus of claim 2, wherein the at least one outdoor-heat-exchanger refrigerant injection port is provided in both or at least either one of a refrigerant pipe that is located directly adjacent to the flow switching valve and the outdoor heat exchanger, the flow switching valve and the outdoor heat exchanger being located on opposing ends of the refrigerant pipe that is located directly adjacent to the flow switching valve and the outdoor heat exchanger, and of a refrigerant pipe that is located directly adjacent to the first expansion valve and the outdoor heat exchanger, the first expansion valve and the outdoor heat exchanger being located on opposing ends of the refrigerant pipe that is located directly adjacent to the first expansion valve and the outdoor heat exchanger.

7. The air-conditioning apparatus of claim 2, further comprising a heat exchanging unit that exchanges heat between the refrigerant flowing through a refrigerant pipe that is connected to a suction side of the compressor and the refrigerant retained in the excess refrigerant container, wherein the refrigerant to be suctioned into the compressor is suctioned into the compressor after exchanging heat with the refrigerant retained in the excess-refrigerant container at the heat exchanging unit.

8. The air-conditioning apparatus of claim 3, further comprising a heat exchanging unit that exchanges heat between the refrigerant flowing through a refrigerant pipe that is connected to a suction side of the compressor and the refrigerant retained in the excess refrigerant container, wherein the refrigerant to be suctioned into the compressor is suctioned into the compressor after exchanging heat with the refrigerant retained in the excess-refrigerant container at the heat exchanging unit.

9. The air-conditioning apparatus of claim 4, further comprising a heat exchanging unit that exchanges heat between the refrigerant flowing through a refrigerant pipe that is connected to a suction side of the compressor and the refrigerant retained in the excess refrigerant container, wherein the refrigerant to be suctioned into the compressor is suctioned into the compressor after exchanging heat with the refrigerant retained in the excess-refrigerant container at the heat exchanging unit.

10. The air-conditioning apparatus of claim 6, further comprising a heat exchanging unit that exchanges heat between the refrigerant flowing through a refrigerant pipe that is connected to a suction side of the compressor and the refrigerant retained in the excess-refrigerant container, wherein the refrigerant to be suctioned into the compressor is suctioned into the compressor after exchanging heat with the refrigerant retained in the excess-refrigerant container at the heat exchanging unit.

11. The air-conditioning apparatus of claim 1, wherein the at least one outdoor-heat-exchanger refrigerant injection port is provided on a refrigerant pipe that is located directly adjacent to the first expansion valve and the outdoor heat exchanger, the first expansion valve and the outdoor heat exchanger being located on opposing ends of the refrigerant pipe that is located directly adjacent to the first expansion valve and the outdoor heat exchanger.

12. The air-conditioning apparatus of claim 1, wherein the refrigerant pipe that is directly connected to the outdoor heat exchanger structurally extends from the outdoor heat exchanger, and the outdoor-heat-exchanger refrigerant injection port is structurally attached to the refrigerant pipe that is directly connected to the outdoor heat exchanger at a position located on the refrigerant pipe that is directly connected to the outdoor heat exchanger.

13. The air-conditioning apparatus of claim 1, wherein the refrigerant pipe that is located directly adjacent to the first expansion valve and the excess-refrigerant container structurally extends from the first expansion valve to the excess-refrigerant container, and the at least one excess-refrigerant-container refrigerant injection port is structurally attached to the refrigerant pipe that is located directly adjacent to the first expansion valve and the excess-refrigerant container at a position located on the refrigerant pipe that is located directly adjacent to the first expansion valve and the excess-refrigerant container.

* * * * *